United States Patent [19]

Yano et al.

[11] 3,996,550

[45] Dec. 7, 1976

[54] SLIDABLE VARIABLE RESISTOR OF ELECTRIC SHOCK PREVENTION TYPE

[75] Inventors: Tadashi Yano, Katano; Shozo Watanabe, Moriguchi, both of Japan

[73] Assignee: Matsushita Electric Industrial Co., Ltd., Japan

[22] Filed: Dec. 29, 1975

[21] Appl. No.: 644,904

[30] Foreign Application Priority Data

Oct. 1, 1975 Japan ..... 50-6429[U]

[52] U.S. Cl. ..... 338/183; 338/161; 338/176; 338/184

[51] Int. Cl.[2] ..... H01C 10/06; H01C 10/38

[58] Field of Search ..... 338/160, 161, 176, 183, 338/184, 194, 197, 199

[56] References Cited

UNITED STATES PATENTS

| | | | |
|---|---|---|---|
| 3,588,779 | 6/1971 | Goerg | 338/183 |
| 3,639,880 | 2/1972 | Oka | 338/176 |
| 3,887,892 | 6/1975 | Rozema et al. | 338/183 |

*Primary Examiner*—C. L. Albritton
*Attorney, Agent, or Firm*—Burgess, Ryan and Wayne

[57] ABSTRACT

A slidable avriable resistor to be used in television receiver and in stereophonic set comprises a lower case member of an insulating material having a resistor member and a conductor on it disposed in lengthwise direction, a upper metallic cover having a long opening in lengthwise direction at the top of the cover, a slidable member of an insulating material with an arm projecting through the opening from the top of the slidable member having a brush extending from the lower side of the slidable member and sliding on the resistor and the conductor for electric conduction, and a flat rectangular plate of insulating material slidably disposed through a passage in the slidable body. By this construction should any metallic piece enter through the opening, the metallic piece is prevented from making contact with the resistor member or the conductor. Thus unexpected electric shock or damage can be prevented.

3 Claims, 10 Drawing Figures

SLIDABLE VARIABLE RESISTOR OF ELECTRIC SHOCK PREVENTION TYPE

BACKGROUND OF THE INVENTION

The present invention relates to a slidable variable resistor and more particularly to the construction of a slidable variable resistor, in which a man touching the resistor is prevented from any accidental electric shock.

Variable slidable resistors are used in many electrical home appliances, such as radio sets, television receivers, stereo sets and the like for the purpose of controlling the volume of sound, the brightness of images on screen and what not. An accidental falling of a piece of conductor into the case of the resistor through the opening may cause not only a serious shock to the man who touches it but also a serious damage to the set by short circuiting the resistor member or the conductor member in the slidable variable resistor.

SUMMARY OF THE INVENTION

The purpose of the present invention is to prevent any unexpected accidents, such as electric shock to the man who touches to the household appliances, and any damage resulting from a short circuit that might occur.

A sliding member of insulating material over resistor member and conductor member is provided with a passage or an opening consisting of U-shaped end portions at both ends of the sliding member and an inverted U-shaped central portion therebetween, all aligned. An insulating flat plate whose length is equal to the inside length of the case, and whose width is wider than the width of the rectangular opening at the top of the upper cover and less than the width of the passage within the sliding member of insulating material, is slidably disposed through the passage for the prevention of any metallic member falling into the upper case and making contact with the resistor member or conductor member.

According to the present invention the construction of the variable resistor is accomplished by only changing the structure of the sliding member, without changing any other constructions of the remaining portion of the conventional slidable resistor, and incorporating an insulating flat plate to the sliding member. The configuration of such resistors of this invention into television sets, stereo sets, or the like, will improve the safety of the sets and will broaden its field of application.

DETAILED DESCRIPTION OF THE INVENTION

Prior Art

Figure 1:
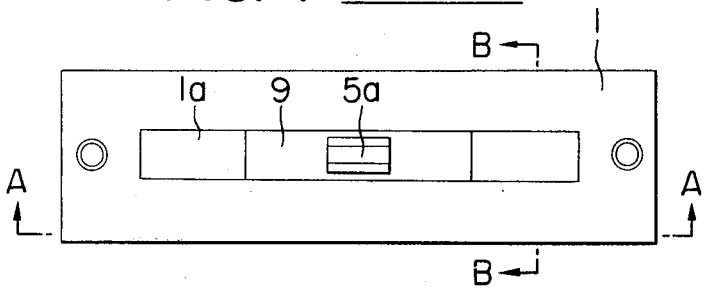
FIG. 1 PRIOR ART
FIG. 1 shows the plan view of a conventional slidable variable resistor.
Figure 2:
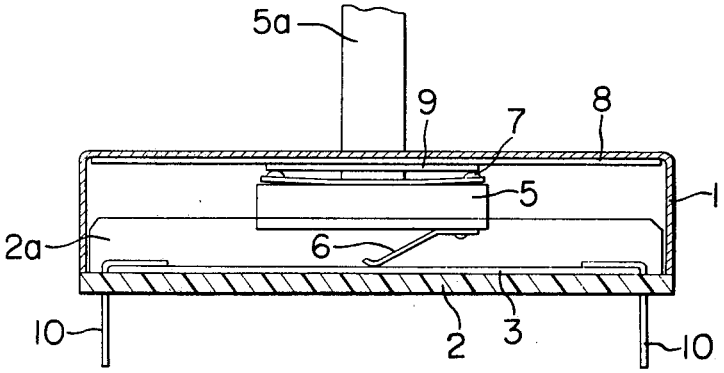
FIG. 2 PRIOR ART
FIG. 2 shows a cross-sectional view of the resistor shown in FIG. 1 taken along the line A—A.
Figure 3:
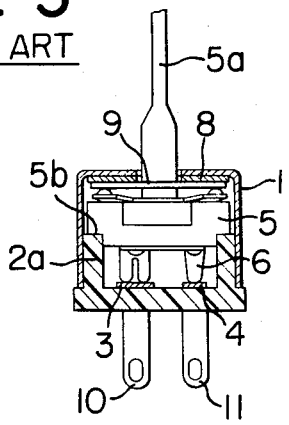
FIG. 3 PRIOR ART
FIG. 3 shows a cross-sectional view of the resistor shown in FIG. 1 taken along the line B—B.
Figure 4:
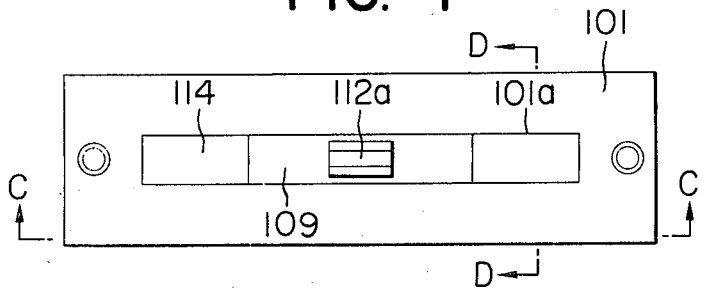
FIG. 4 shows a plan view of a slidable variable resistor according to the present invention.
Figure 5:
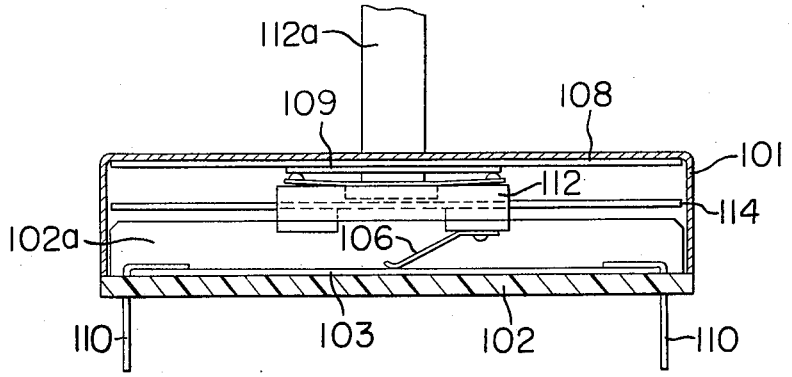
FIG. 5 shows a cross-sectional view of the slidable variable resistor shown in FIG. 4 taken along the line C—C.
Figure 6:
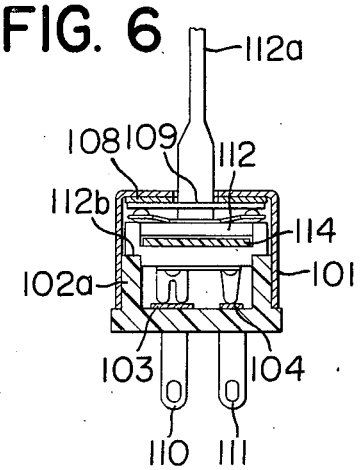
FIG. 6 shows a cross-sectional view of the slidable variable resistor shown in FIG. 4 taken along the line D—D.
Figure 7:
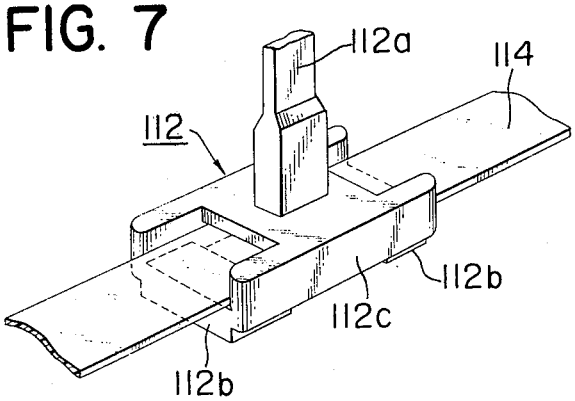
FIG. 7 shows a perspective view of a slidable member and an insulating flat plate, and their relation in the slidable variable resistor.
Figure 8:
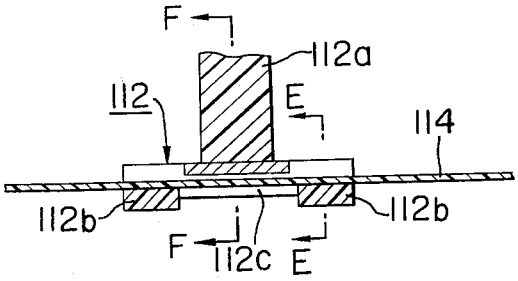
FIG. 8 shows a cross-sectional view of the slidable member and the flat plate shown in FIG. 7.
Figure 9:
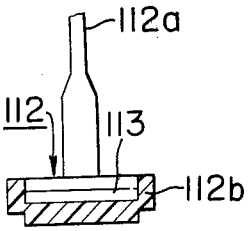
FIG. 9 shows a cross-sectional view of the slidable member and the flat plate shown in FIG. 8 taken along the line E—E.
Figure 10:
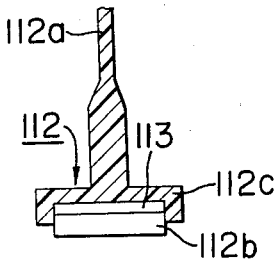
FIG. 10 shows a cross-sectional view of the slidable member and the flat plate shown in FIG. 8 taken along the line F—F.

Referring to FIGS. 1 through 3, the numeral 1 designates a metallic cover of an inverted U-shape portion having a rectangular opening 1a at the top of the cover. The numeral 2 designates a lower case member made of insulating material, being attached at the bottom of the upper cover. On the lower case member 2 are fixed a resistor member 3 and a conductor member 4 in parallel with each other. The numeral 5 designates a sliding member of insulating material, slidably disposed on guides within the upper cover and the lower case member; the cut out portions **5*b* along the sliding direction at both bottom corners of the sliding member 5 are slidably mounted on the guide beds 2*a* of the lower case member 2. The lower side of the sliding member 5 is provide with a brush 6 slidably contacting the resistor member 3 and the conductor member 4 being fixed on the upper side of the case member. An elastic member 7 is provided to slide smoothly sliding member 5 on the guide beds 2*a*. There is also provided arm 5*a* projecting out through the opening 1*a* of the upper cover 1, which may be an extension of the sliding member or a separate member fixed to the sliding member 5. The numeral 8 designates a guide plate disposed inside of the metal cover for the purpose of smoothly sliding the sliding member 5; and the numeral 9 designates another guide member disposed on the sliding member 5 for the same purpose. The numerals 10 and 11 designate terminals for the resistor member 3 and the conductor member 4** respectively.

It is a well known fact that, as the sliding member 5 is slid by means of the arm **5*a*, the brush 6 is also slided over the resistor member 3 and the conductor member 4;** thus any desired resistance value can be obtained.

Should a piece of metal go through the opening **1*a* the metal may make contact with the resistor member 3 or the conductor member 4,** which may cause an electric shock to a man, leakage in the set, or some other unexpected accident.

PREFERRED EMBODIMENT OF THE INVENTION

Referring to FIGS. 4 through 10, the numeral 112 designates a sliding member made of insulating material slidably disposed between the metallic upper cover and a lower case member. The numeral 113 designates a passage or a hole comprising two U-shaped end portions **112*b* and an inverted U-shape central portion 112*c* of the sliding member 112, all portions being in alignment in the sliding direction of the slidable variable resistor. The numeral 114 designates a flat plate of insulating material having a length of the inside length of the upper cover 101, and the width about equal to that of the passage 113, that is, the width of the insulating flat plate is wider than the width of the rectangular opening at the top of the upper cover and less than the width of the passage lying in the axial direction within the sliding member slidably fit into the passage 113. The numeral 112a** designates an adjusting arm.

In this embodiment, should a piece of metal or metallic wire go into the cover 101 through the opening 101*a*, the metallic pieces is prevented by the insulating plate 114 from contacting the resistor member 103 or conductor member 104 locating on the lower case member 102. Thus unexpected short circuiting or electric shock can be prevented.

What is claimed is:

1. A slidable variable resistor comprising:

an upper cover having a cross section of U-shape being placed upside down and having a rectangular opening at the top of said upper cover;

a lower case member of insulating material being placed underside of said upper cover;

a resistor member and a conductor member disposed on said lower case member;

a sliding member of insulating material having a brush making contact with said resistor member and said conductor member, and connecting said resistor and conductor members, being slidably disposed between said upper cover and said lower case member, and having an arm projecting through said opening at the top of said upper cover; and an insulating flat plate having a length about equal to the inside length of said upper cover, and a width wider than the width of said rectangular opening at the top of said upper cover and less than the width of a passage lying in the axial direction within said sliding member, slidably disposed in a passage in said sliding member in parallel with the top of said upper cover.

2. A slidable variable resistor as set forth in claim 1 wherein the both end portions and the central portion of said sliding member are of U-shape and of inverted U-shape respectively, and all said portions being in alignment.

3. A slidable variable resistor as set forth in claim 1 wherein cut out portions at bottom corners of said sliding member slide on guide beds of both sides of said lower case member.

* * * * *